United States Patent [19]

Bhalla

[11] 4,152,619

[45] May 1, 1979

[54] HID LAMP ELECTRODE COMPRISING BARIUM (YTTRIUM OR RARE EARTH METAL) TUNGSTATE OR MOLYBDATE

[75] Inventor: Ranbir S. Bhalla, West Paterson, N.J.

[73] Assignee: Westinghouse Electric Corp., Pittsburgh, Pa.

[21] Appl. No.: 845,521

[22] Filed: Oct. 26, 1977

[51] Int. Cl.[2] ..... H01J 1/14; H01J 61/20

[52] U.S. Cl. ..... 313/218; 313/227; 313/229; 313/346 R; 313/213

[58] Field of Search ..... 313/218, 346 R, 311, 313/213, 227, 229

[56] References Cited

U.S. PATENT DOCUMENTS

| | | | |
|---|---|---|---|
| 3,170,081 | 2/1965 | Rokosz | 313/213 |
| 4,052,634 | 10/1977 | DeKok | 313/218 X |

*Primary Examiner*—Rudolph V. Rolinec
*Assistant Examiner*—Darwin R. Hostetter
*Attorney, Agent, or Firm*—W. D. Palmer

[57] ABSTRACT

For HID lamps, and particularly high-pressure mercury or sodium-mercury HID lamps, the electron-emissive material portion of the lamp electrodes is $M_3M'_2M''O_9$ wherein M is alkaline-earth metal and at least principally comprises barium; M′ is yttrium, a lanthanoid series metal, or any mixtures thereof; and M″ is tungsten, molybdenum, or mixtures thereof. The specified material is very stable and highly emissive.

7 Claims, 6 Drawing Figures

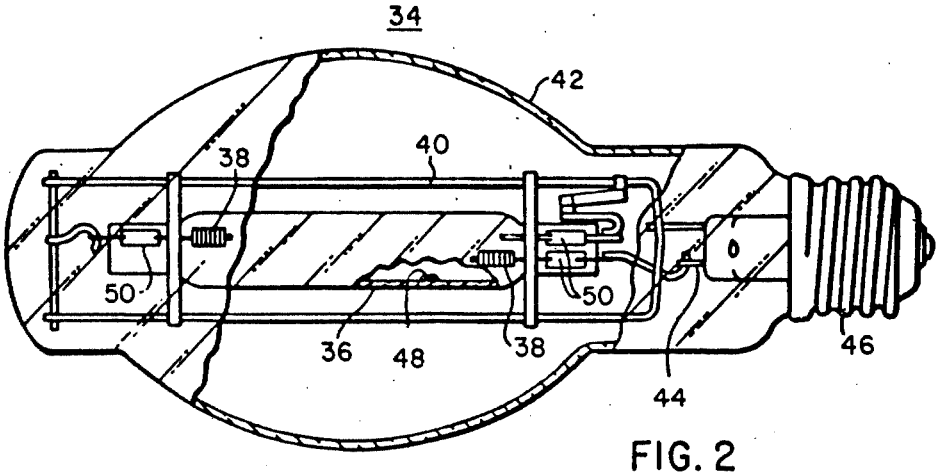
FIG. 2
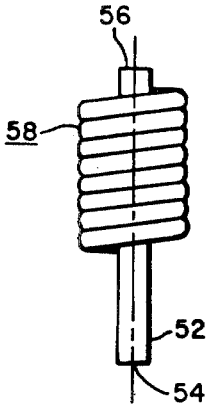
FIG. 3
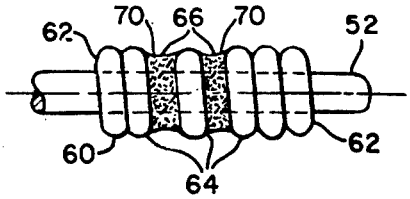
FIG. 6
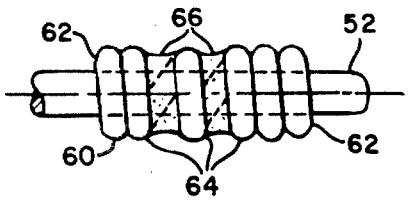
FIG. 4
FIG. 5
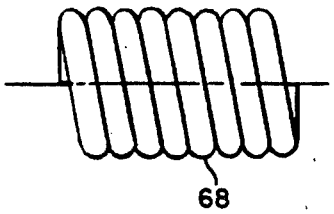

HID LAMP ELECTRODE COMPRISING BARIUM (YTTRIUM OR RARE EARTH METAL) TUNGSTATE OR MOLYBDATE

CROSS-REFERENCE TO RELATED APPLICATION

In copending application Ser. No. 844,154, filed Oct. 21, 1977 by Ranbir S. Bhalla, the present applicant, and owned by the present assignee, is disclosed an emissive material for HID lamp electrodes which comprises a solid solution of dibarium calcium tungstate and dibarium calcium molybdate, wherein the molar ratio of tungstate to molybdate is from 9:1 to 1:9.

BACKGROUND OF THE INVENTION

This invention relates to high-intensity-discharge (HID) lamps and, more particularly, to improved electron emissive material for the electrodes of such lamps.

In U.S. Pat. No. 3,708,710 dated Jan. 2, 1973 is disclosed a high-intensity-discharge sodium-mercury vapor lamp which utilizes dibarium calcium tungstate as electron emissive material. Such material has been used in so-called dispenser cathodes and U.S. Pat. No. 3,434,812 dated Mar. 25, 1969 discloses the use of dibarium calcium tungstate or dibarium strontium tungstate as an emissive material in a dispenser cathode.

Dibarium calcium molybdate is known for use as a getter layer material in conjunction with an incandescent lamp, as disclosed in U.S. Pat. No. 3,266,861, dated Aug. 16, 1966. In addition, high-pressure mercury vapor lamps and sodium-mercury vapor lamps have in the past utilized as electron emissive material a mixture of several oxide phases comprising thorium dioxide, barium thorate, dibarium calcium tungstate and barium oxide. This mixture of oxide phases is quite sensitive to the atmospheric contaminants with the result that even a brief exposure to the air can result in a relatively large pickup of water and carbon dioxide by the emission mixture, which contaminants are rather difficult to remove. In such a mixture, the thorium dioxide serves as a matrix for the more active oxide emitters such as the barium oxide, dibarium calcium tungstate and barium thorate.

SUMMARY OF THE INVENTION

There is provided in combination with an HID lamp comprising a radiation-transmitting arc tube having electrodes operatively supported therein proximate the ends thereof and adapted to have an elongated arc discharge maintained therebetween, together with means for connecting the electrodes to an energizing power source, the improved electrode structure for the lamp electrodes, each of which comprises: an elongated refractory metal member having one end portion thereof supported proximate an end of the arc tube and the other end portion of the metal member projecting a short distance inwardly within the arc tube. An overfitting refractory metal coil means is carried on the inwardly projecting portion of the elongated metal member. In accordance with the present invention, electron emissive material is carried intermediate turns of the overfitting coil means and the electron emissive material consists essentially of $M_3M'_2M''O_9$, wherein: M is alkaline-earth metal and at least principally comprises barium; M' is yttrium, a lanthanoid series metal, or any mixtures thereof; and M'' is tungsten, molybdenum, or mixtures thereof. For some types of lamps, it is preferred to mix refractory metal powder with the specified emissive material with the powder constituting from 5% to 80% by weight of the emissive material.

BRIEF DESCRIPTION OF THE DRAWINGS

For a better understanding of the invention, reference may be had to the preferred embodiment, exemplary of the invention, shown in the accompanying drawings, in which:

FIG. 2 is an elevational view, shown partly in section, of an HID mercury-vapor lamp which incorporates the present electrodes;

FIG. 3 is an enlarged view of the electrode tip portion showing the refractory coil carried thereon;

FIG. 4 is an elevational view of the tip portion of the electrode as partially fabricated showing an inner coil which has the improved electron emissive material carried intermediate spaced turns thereof;

FIG. 5 is an elevational view of the overfitting coil which is screwed in place onto the inner coil as shown in FIG. 4 in order to complete the electrode; and FIG. 6 is an enlarged view of an electrode tip portion generally corresponding to FIG. 3, but wherein the emission material has added thereto finely divided refractory metal particles.

DESCRIPTION OF THE PREFERRED EMBODIMENTS

Figure 1:
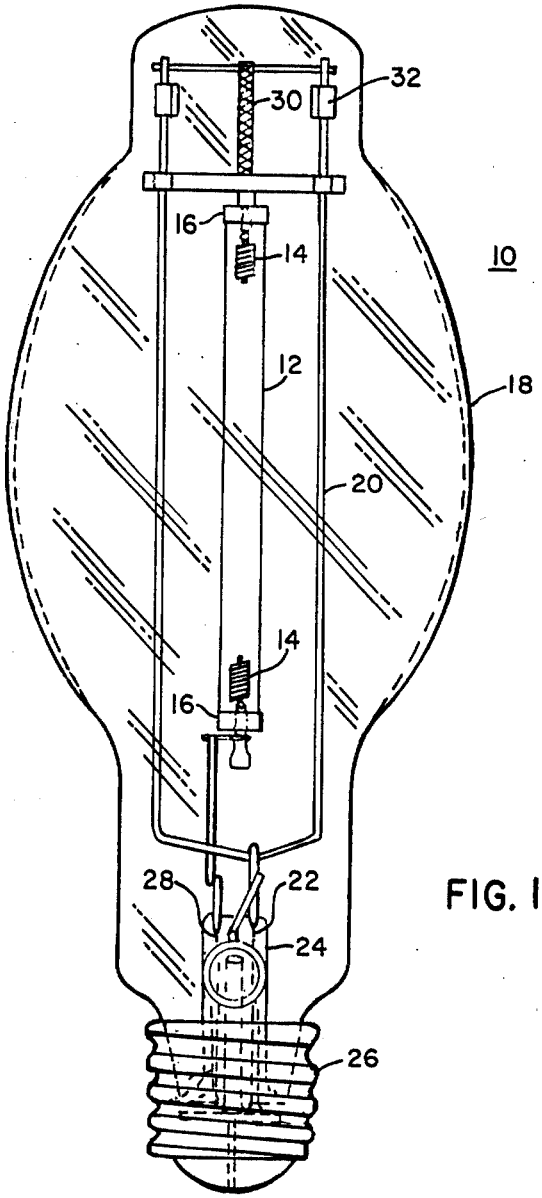
FIG. 1 is an elevational view of a typical HID sodium-mercury lamp which incorporates the present improved electrodes.

With specific reference to the form of the invention illustrated in the drawings, the lamp 10 in FIG. 1 is a typical HID sodium-mercury lamp comprising a radiation-transmitting arc tube 12 having electrodes 14 operatively supported therein proximate the ends thereof and adapted to have an elongated arc discharge maintained therebetween. The arc tube is fabricated of refractory material such as single crystal or polycrystalline alumina having niobium end caps 16 sealing off the ends thereof. The arc tube 12 is suitably supported within a protective outer envelope 18 by means of a supporting frame 20 which is connected to one lead-in conductor 22 sealed through a conventional stem press arrangement 24 for connection to the conventional lamp base 26. The other lead-in conductor 28 connects to the lower lamp electrode 14. Electrical connection to the uppermost electrode 14 is made through the frame 20 and a resilient braided connector 30 to facilitate expansion and contraction of the arc tube 12 and the frame 20 is maintained in position within the bulb by suitable metallic spring spacing members 32 which contact the inner surface of the dome portion of the protective envelope 18. As a discharge-sustaining filling, the arc tube contains a small measured charge of sodium-mercury amalgam and a low pressure of inert ionizable starting gas such as 20 torrs of xenon.

The high-pressure mercury-vapor lamp 34 as shown in FIG. 2 is also generally conventional and comprises a light transmitting arc tube 36 which is usually fabricated of quartz having the operating electrodes 38 operatively supported therein proximate the ends thereof and adapted to have an elongated arc discharge maintained therebetween. The conventional supporting frame 40 serves to suitably support the arc tube within the protective outer envelope 42 and to provide electrical connection to one of the electrodes. The other electrode is connected directly to one of the lead-in conductors 44 and thence to the base 46 so that the combination provides means for connecting the lamp electrodes 38 to an energizing power source. As is conventional, the lamp contains a small charge of mercury 48 which together with an inert ionizable starting gas comprises a discharge-sustaining filling. In this lamp embodiment, ribbon seals 50 provided at the ends of the arc tube 36 facilitate sealing the lead-in conductors therethrough in order to connect to the electrodes.

In FIG. 3 is shown an enlarged fragmentary view of an electrode suitable for use in an HID lamp. The electrode comprises an elongated refractory metal member 52 having one end portion thereof 54 which is adapted to be supported proximate an end of the lamp arc tube with the other end portion 56 of the metal member adapted to project a short distance inwardly within the arc tube. An overfitting refractory metal coil means 58 is carried on the elongated metal member 52 proximate the end 56 thereof. As a specific example, the elongated metal member is formed as a tungsten rod having a diameter of approximately 0.032 inch (0.8 mm) and the overfitting coil 58 as shown in FIG. 3 comprises eight turns of tungsten wire which has a diameter of 0.016 inch (0.4 mm). The outer diameter of the coil 58 can vary from 0.09 inch (2.29 mm) to 0.11 inch (2.8 mm).

The electrode coil in a state of partial assembly is shown in FIGS. 4 and 5 wherein the elongated refractory metal member 52 has a first inner coil 60 wrapped directly thereon and having such pitch between individual turns intermediate the coil ends 62 that there exists a predetermined spacing between the centrally disposed turns 64. As a specific example, the spacing between the centrally disposed individual turns 64 is approximately equal to the diameter of the wire from which the inner coil is formed. This spacing forms a protected repository for the majority of the emission material 66 which is carried by the electrode structure. An electrode construction such as the foregoing is generally known in the art, as disclosed in U.S. Pat. No. 3,170,081 dated Feb. 16, 1965.

In accordance with the present invention, the electron emissive material 66 consists essentially of $M_3M'_2M''O_9$, wherein: M is alkaline-earth metal and at least principally comprises barium; M' is yttrium, a lanthanoid series rare-earth metal, or mixtures thereof; and M'' is tungsten, molybdenum, or mixtures thereof. For purposes of the description, the species barium yttrium tungstate ($Ba_3Y_2WO_9$) will be considered in detail. This material and all materials within the foregoing genus have perovskite-like structures and all provide very similar x-ray diffraction patterns which clearly identify the compounds. In the case that tungstates and molybdates are mixed in any portions, the two materials form solid solutions of the two end members and still display the perovskite-like structure when examined by x-ray diffraction. As a specific example for preparing the barium yttrium tungstate, there is mixed finely divided barium carbonate, yttrium oxide and tungstic oxide ($WO_3$) in such relative gram mole proportions as desired in the final material. These raw-mix constituents are placed in an alundum or alumina crucible and heated from room temperature to 800° C. in an air atmosphere. This temperature is maintained for two hours and the heating temperature is then raised to 1100° C. and maintained for an additional two hours. Thereafter, the material is cooled and ground and then refired at about 1350° C. in an air atmosphere for four hours. The final material is extremely stable and preparatory to use, it is ground to very finely-divided form for which a representative particle size is about 11 microns. The powder material is then formed into a thick paste using an alcohol vehicle and the paste is applied over the innermost coil 60, as shown in FIG. 4. After drying, the outer coil 68 as shown in FIG. 5, is screwed in place over the inner coil which provides a substantial degree of protection to prevent the electron emissive material 66 from becoming dislodged. The lamp electrodes are then mounted within the arc tube in conventional fashion and the lamp is completed. The actual amount of emission material can vary and for a typical electrode as described hereinbefore, approximately 60 to 70 mg of emission material incorporated in each electrode for a 400 watt lamp provides excellent performance.

The barium provides the primary electron-emitting constituent in the foregoing emission material and for this reason, the alkaline-earth metal should at least principally comprise barium. Alternatively, calcium or strontium or mixtures thereof can be substituted for a portion of the barium and, as an example, 20 mole percent of the total barium in the raw mix may have calcium or strontium or mixtures thereof substituted therefor. The yttrium can have substituted therefor any lanthanoid series rare earth metal or any mixtures thereof, added to the raw mix as the oxide for example, and only a portion of the yttrium need be substituted by the rare earth metal. Apparently the function of yttrium or the lanthanoid series rare earth metal is to provide with the tungstate or molybdate an extremely stable and high-temperature resistant compound which retains the primary emissive material, namely the barium. As indicated hereinbefore, the molybdate variety of the present emission material forms solid solutions with the tungstate in all proportions and the molybdate can be substituted for part or all of the tungstate accordingly, added to the raw mix as the oxide, for example.

As used in sodium-mercury HID lamps, the foregoing emitters have proved to be extremely stable under the discharge environment and their performance in mercury vapor HID lamps is also excellent. When these emission materials are exposed to air for prolonged periods, again there is no noticeable reaction and this simplifies fabrication of the lamp electrodes since no special precautions need be taken. On exposure to water, materials such as barium yttrium tungstate and barium yttrium molybdate can show some incipient decomposition into their components after prolonged periods such as 24 hours contact with excess water, but even this is not harmful since the compounds reform during the lamp fabrication procedures when they are initially tested by "flashing" to expose the electrodes to temperatures of approximately 1500° C.

In the case of mercury vapor HID lamps, it is desirable to mix with the emissive material finely divided refractory metal particles of tungsten, molybdenum, tantalum or niobium, or mixtures thereof, with the refractory metal powder comprising from 5% to 80% by weight of the emission material. This metal powder desirably is in an extremely fine state of division with a representative particle size for the powder being 0.06 to 0.2 micron. Tungsten powder is preferred with a specific particle size being about 0.11 micron. The added metal powder acts as a refractory matrix to increase the mechanical stability of the emission material and it also minimizes sputtering of the oxide emission material when the lamp is initially started. The preferred finely divided tungsten powder preferably comprises from about 15% to about 50% by weight of the emission material which in its preferred form is barium yttrium tungstate. Such a modified mixture is shown in FIG. 6 wherein the emission material 66 has the finely divided tungsten particles 70 mixed therewith in amount of about 40% by weight of the emission material.

In tests conducted to date for mercury vapor HID lamps which incorporate the present emission mixture and control lamps which were similar but which utilized the previous mixed oxide phases comprising thorium dioxide, barium thorate, dibarium calcium tungstate and barium oxide, the present lamps in 400 watt size have averaged 1700 to 2170 lumens increased output after 1,000 hours operation as compared to the control lamps. In addition, lower starting voltages are normally obtained with the present improved emission mixture varying from between 6 volts to 26 volts lower, as compared to the control lamps using the prior art mixed oxide phases as emission material.

What is claimed is:

1. In combination with a high-intensity vapor-discharge lamp comprising a radiation-transmitting arc tube having electrodes operatively supported therein proximate the ends thereof and adapted to have an elongated arc discharge maintained therebetween, and means for connecting said electrodes to an energizing power source, the improved structure for said electrodes, each of which comprises:

(a) an elongated refractory metal member having one end portion thereof supported proximate an end of said arc tube and the other end portion of said metal member projecting a short distance inwardly within said arc tube, an overfitting refractory metal coil means carried on the inwardly projecting portion of said elongated metal member; and (b) electron emissive material carried intermediate turns of said overfitting coil means, said electron emissive material consists essentially of $M_3M'_2M''O_9$, wherein: M is alkaline-earth metal and at least principally comprises barium; M′ is yttrium, a lanthanoid series rare-earth metal, or mixtures thereof; and M″ is tungsten, molybdenum, or mixtures thereof.

2. The combination as specified in claim 1, wherein very finely divided tungsten, molybdenum, tantalum, or niobium powder or mixtures thereof is mixed with said electron emissive material, and said powder comprises from 5% to 80% by weight of said electron emissive material.

3. The combination as specified in claim 2, wherein said finely divided powder is tungsten powder and comprises from about 15% to about 50% by weight of said emission material.

4. The combination as specified in claim 3, wherein said electron emissive material is $Ba_3Y_2WO_9$.

5. The combination as specified in claim 4, wherein said overfitting coil means comprises a first inner coil wrapped directly on said elongated refractory metal member and having such pitch between individual turns intermediate the coil ends that there exists a predetermined spacing between such individual turns, and a second coil overfitting said first coil and having a tight spacing between individual turns thereof, and said electron emissive material and said tungsten powder carried between said spaced individual turns of said first coil intermediate the ends thereof.

6. The combination as specified in claim 1, wherein said high-intensity discharge lamp is a high-pressure sodium-mercury vapor discharge lamp.

7. The combination as specified in claim 2, wherein said high-intensity discharge lamp is a high-intensity mercury-vapor discharge lamp.

* * * * *